US006440649B1

(12) United States Patent
Simpson et al.

(10) Patent No.: US 6,440,649 B1
(45) Date of Patent: Aug. 27, 2002

(54) X-RADIATION PHOTOTHERMOGRAPHIC MATERIALS AND METHODS OF USING SAME

(75) Inventors: Sharon M. Simpson, Lake Elmo, MN (US); William E. Moore, Macedon, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/867,984

(22) Filed: May 30, 2001

(51) Int. Cl.[7] ..... G03C 1/498; G03C 5/16

(52) U.S. Cl. ..... 430/351; 430/139; 430/523; 430/570; 430/604; 430/605; 430/610; 430/944; 430/966

(58) Field of Search ..... 430/139, 619, 430/351, 610, 604, 605, 523, 944, 570

(56) References Cited

U.S. PATENT DOCUMENTS 4,480,024 A * 10/1984 Lyon et al. ..... 430/139

4,865,944 A 9/1989 Roberts et al.

FOREIGN PATENT DOCUMENTS

JP 11-283960 10/1999
JP 11-196657 1/2001

OTHER PUBLICATIONS

K. Becker, Roentgenstr, 1961a, 95, 694.

K.Becker, E. Klein & E. Zeitler, Naturwissenschafter, 1960, 47, 199.

* cited by examiner

*Primary Examiner*—Thorl Chea
(74) *Attorney, Agent, or Firm*—J. Lanny Tucker

(57) ABSTRACT

X-radiation sensitive photothermographic imaging materials contain X-radiation sensitive phosphors in association with photosensitive silver halide. These phosphors provide an increase in imaging sensitivity and improved image contrast. Both intensifying and storage phosphors can be used.

25 Claims, No Drawings

X-RADIATION PHOTOTHERMOGRAPHIC MATERIALS AND METHODS OF USING SAME

FIELD OF THE INVENTION

This invention relates to X-radiation sensitive thermally-developable imaging materials. In particular, this invention relates to X-radiation sensitive photothermographic materials containing X-radiation responsive phosphors that provide increased sensitivity (photographic speed). This invention also relates to methods of imaging using these photothermographic materials.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) photosensitive catalyst (such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in situ", for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 1996, 40, 104]. Alternatively, a portion of the reducible silver ions can be completely converted to silver halide, and that portion can be added back to the source of reducible silver ions (see Usanov et al., International Conference on Imaging Science, Sep. 7–11, 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing-clusters of latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer", may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. Upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

Moreover, in photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

In addition, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, 94–103, and in M. R. V. Sahyun, *J. Imaging Sci. Technol.* 1998, 42, 23.

Problem to be Solved

Historically, photographic films containing various silver halides have been used for various radiographic purposes. Such films have exhibited excellent sensitivity to X-radiation, high spatial resolution, low image noise, and archival storage properties. Desired sensitivity to imaging X-radiation has been achieved through amplification of a relatively small number of latent image centers without too much "noise" being added to the image. However, such films require the use of undesirable aqueous processing solutions and equipment.

The term "noise" is understood in radiography to refer to the random variations in optical density throughout a radiographic image that impair the user's ability to distinguish objects within the image. Radiographic noise is considered to have a number of components identified in the art as "quantum mottle", film grain, and "structure mottle", as noted for example by Ter-Pogossian, *The Physical Aspects of Diagnostic Radiology*, Harper & Row, New York, Chapter 7, 1967.

Wet-processed radiographic films have generally been used in combination with some other material to convert X-radiation to another radiation form that can be more readily detected by silver halide in the films. Generally, such radiation "converting" materials are metal plates or metal oxides that convert X-radiation to electrons, or inorganic phosphors that convert X-radiation to visible radiation. Such "converting" materials are also usually provided in a separate element in what is known as "metal screens", "intensifying screens" or "phosphor panels" because if phosphors or metal oxides are included within the typical silver halide emulsion, very high image noise levels result. This is due to the fact that electrons or visible radiation from the "converting" materials will expose many silver halide grains at the same time, including those outside of the "image area". Upon development, the exposed silver halide grains are "correlated" (that is, all the grains in the vicinity of the phosphor particle are developed, giving rise to high image noise. Thus, metal or phosphor intensifying screens or panels have been commonly used in combination with radiographic films in what are known as cassettes or radiographic imaging assemblies.

Attempts to incorporate phosphors in wet silver halide to improve sensitivity to X-radiation have been not been favored. K. Becker and coworkers found that incorporation of p-terphenyl into an wet silver halide emulsion gave a material with a flat energy response between 10 keV and 1000 keV but with an excessive amount of noise (K. Becker, E. Klein, and E. Zeitler, *Naturwissen-schaften,* 1960, 47, 199, K. Becker, *Roentgenstr,* 1961a, 95, 694, and K. Becker, *Roentgenstr,* 1961b, 95, 939).

Efforts have been made to achieve increased photographic speed in photothermographic materials because such materials offer a number of important advantages over the use of conventional wet-processed photographic materials. However, a significant problem with photothermographic materials is the difficulty in achieving high speed without accompanying increases in unwanted density ($D_{min}$) or a loss in image contrast.

Another problem arises in such materials because the level of silver halide is relatively low compared to wet-processed photographic materials. Thus, direct exposure of such materials to X-radiation would require that a very high dosage be delivered to the film (through a patient) in order to produce a useful image. Obviously, this would be unacceptable for both human and animal subjects.

One approach to reducing the amount of X-radiation exposure needed to produce an image in photothermographic materials is to place "double faced coatings" of photothermographic materials into contact with metal or phosphor intensifying screens [see for example JP Kokai 2001-109101 (Konica)]. Lamination of the phosphor screen to the photothermographic coating is described in JP Kokai 2001-022027 (Konica). However, there are imaging applications in which the use of such contact screens would be disadvantageous. For example, in the practice of intra-oral dental radiography, reuse of the expensive intensifying screens would require sterilization between uses. In addition, light spread and modulation transfer function (MTF) reducing characteristics associated with intensifying screens can reduce image sharpness to unacceptable levels.

Thus, as indicated in the previous discussion, there is a need for a way to render photothermographic materials X-radiation sensitive without a loss in photospeed or $D_{max}$ or a significant increase in fog ($D_{min}$). There is also a need to achieve this X-radiation sensitivity in photothermographic materials without the use of heavy, bulky, and costly phosphor intensifying screens.

Screens that provide light output matched to the spectral sensitivity of the silver halide in the photothermographic materials would be especially useful.

SUMMARY OF THE INVENTION

The present invention provides an X-radiation sensitive photothermographic material comprising a support having on at least one side thereof, one or more imaging layers comprising a binder and in reactive association:

a. a photosensitive silver halide, b. a non-photosensitive source of reducible silver ions, c. a reducing composition for the reducible silver ions, and d. a phosphor that is sensitive to X-radiation and is present in an amount of at least 0.1 mole per mole of total silver.

Further, a method of this invention for forming a visible image comprises:

A) imagewise exposing the photothermographic material described above to X-radiation to form a latent image, and B) simultaneously or sequentially, heating the exposed photothermographic material to develop the latent image into a visible image.

Still again, the present invention provides an imaging precursor emulsion comprising the following component d in combination with any two or more of the following components a, b, and c:

a. a photosensitive silver halide, b. a non-photosensitive source of reducible silver ions, c. a reducing composition for the reducible silver ions, and d. a phosphor that is sensitive to X-radiation.

We have unexpectedly found that the addition of phosphors to the imaging layers (or adjacent layers) of photothermographic materials provides an increase in sensitivity to X-radiation. Moreover, we have also found that placing phosphors in reactive association with the photosensitive silver halide provides high resolution, image sharpness, and a low level of "noise" and image fog. A relatively small amount of phosphor is needed to provide these benefits.

The present invention further provides an X-radiation sensitive photothermographic material comprising a support having on both sides thereof, one or more of the same or different imaging layers comprising a binder and in reactive association:

a. a photosensitive silver halide, b. a non-photosensitive source of reducible silver ions, c. a reducing composition for the reducible silver ions, and d. a phosphor that is sensitive to X-radiation and is present in an amount of at least 0.1 mole per mole of total silver.

We have also found when photothermographic films incorporating phosphors within the imaging layers (or adjacent layers) are placed in contact with X-ray screens a further increase in sensitivity to X-radiation occurs.

DETAILED DESCRIPTION OF THE INVENTION

The photothermographic materials of this invention can be used, for example, in conventional black-and-white or color photothermography, in electronically generated black-and-white or color hardcopy recording. The imaging precursor emulsions and photothermographic materials of the present invention are preferably used to obtain black-and-white images.

The photothermographic materials of this invention are particularly useful for medical imaging of human or animal subjects in response to X-radiation. Such applications include, but are not limited to, thoracic imaging, mammography, dental imaging, orthopedic imaging, general medical radiography, therapeutic radiography, veterinary radiography, and autoradiography. The materials are also particularly useful for various non-medical uses of X-radiation, for example in X-ray lithography and industrial radiographic applications such the nondestructive testing of welds and for minute flaws which could affect performance.

It is particularly desirable to use the photothermographic materials of this invention to provide black-and-white images of human or animal subjects.

In the photothermographic materials of this invention, the components necessary for imaging can be in one or more layers. The layer(s) that contain a photosensitive silver halide and non-photosensitive source of reducible silver ions, or both, are referred to herein as emulsion layer(s). The photosensitive silver halide and the non-photosensitive source of reducible silver ions are in catalytic proximity and preferably in the same emulsion layer. In addition, the one or more phosphors described herein are also in catalytic proximity or reactive association with the photosensitive silver halide, and are preferably in the same emulsion layer.

Various other layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

The present invention also provides a process for the formation of a visible image (usually a black-and-white image) by first exposing to X-radiation and thereafter heating the inventive photothermographic material. In one embodiment, the present invention provides a process comprising:

A) imagewise exposing the photothermographic material of this invention to X-radiation to generate a latent image, and B) simultaneously or sequentially, heating the exposed photothermographic material to develop the latent image into a visible image.

When the photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component. For example, the phosphors described herein can be used individually or in mixtures.

Heating in a substantially water-free condition as used herein, means heating at a temperature of from about 50° to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, page 374.

"Photothermographic material(s)" means a construction comprising at least one photothermographic emulsion layer or a photothermographic set of layers (wherein the silver halide and the source of reducible silver ions are in one layer and the other essential components, including the phosphor, or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer", or "photothermographic emulsion layer", means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential imaging components (such as the phosphor) and/or desirable additives. These layers are usually on what is known as the "frontside" of the support, but in some embodiments can be on both the frontside and backside of the support.

The four "essential imaging components" required in the photothermographic materials of this invention are the photosensitive silver halide, a non-photosensitive source of reducible silver ions, a reducing composition for the reducible silver ions, and a phosphor. All of these essential imaging components are incorporated into one or more layers of the photothermographic materials during manufacture. In other words, they are not incorporated from an external source has as a laminated element or phosphor screen.

An "imaging precursor emulsion" refers herein to a formulation that includes one or more phosphors and two or more of the three other essential components. In other words, an "imaging precursor emulsion" can include any three or all four of the essential components as long as the phosphor is present.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Short wavelength visible region of the spectrum" refers to that region of the spectrum of from about 400 nm to about 450 nm.

"Visible region of the spectrum" refers to that region of the spectrum of from about 400 nm to about 700 nm.

"Red region of the spectrum" refers to that region of the spectrum of from about 600 nm to about 700 nm.

"Infrared region of the spectrum" refers to that region of the spectrum of from about 700 nm to about 1400 nm.

"Middle chalcogen" means sulfur (S), selenium (Se), or tellurium (Te).

"Non-photosensitive" means not intentionally light sensitive.

"Transparent" means capable of transmitting visible light or imaging radiation without appreciable scattering or absorption.

A "phosphor" is an inorganic compound that is responsive to X-radiation and upon irradiation, emits radiation in the ultraviolet, visible, or infrared region of the spectrum. Most phosphors emit such radiation immediately upon exposure to stimulating radiation. However, some phosphors are known as "storage" phosphors because they have the capacity to store energy from the initial irradiation and to release the light at a later time when stimulated by still other radiation.

The term "RAD" is used to indicate a unit dose of absorbed radiation, that is energy absorption of 100 ergs per gram of tissue.

The terms "kVp" and "MVp" stand for peak voltage applied to an X-ray tube times $10^3$ and $10^6$, respectively.

The term "rare earth" is used to indicate elements having an atomic number of 39 or 57 through 71.

The term "double-sided coating" or "double-faced coating" is used to define an imaging material having the same or different photothermographic imaging or emulsion layers disposed on both the front- and backsides of the support.

As is well understood in this area, for compounds useful herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group", such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example, $CH_3—CH_2—CH_2—O—CH_2—$ or $CH_3—CH_2—CH_2—S—CH_2—$), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photosensitive Silver Halide

As noted above, the photothermographic materials of the present invention include one or more photosensitive silver halides such as silver bromide, silver iodide, silver chloride, silver bromoiodide, silver chlorobromoiodide, silver chlorobromide, and others readily apparent to one skilled in the art. Mixtures of photosensitive silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure,* 1978, Item 17643.

The shape of the photosensitive silver halide grains used in the present invention is in no way limited. The silver halide grains may have any crystalline habit including, but not limited to, cubic, octahedral, rhombic, dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic or tabular morphology are preferred.

The photosensitive silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps".

Preformed silver halide emulsions used in the materials of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.), all incorporated herein by reference].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75, all incorporated herein by reference.

A preferred method of making photosensitive silver halide grains is described in copending and commonly assigned U.S. Ser. No. 09/833,533 (filed Apr. 12, 2001 by Shor, Zou, Ulrich, and Simpson), in which the silver halide grains are prepared in the presence of a hydroxytetrazaindene or N-heterocyclic compound comprising a mercapto group (such as 1-phenyl-5-mercaptotetrazole). This application is incorporated herein by reference.

The photosensitive silver halide grains used in the present invention can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis", ASTM Symposium on Light Microscopy, R. P. Loveland, 1955, pp. 94–122, and in C. E. K. Mees and T. H. James, *The Theory of the Photographic Process*, Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

The one or more photosensitive silver halides used in the photothermographic materials of the present invention are preferably present in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides used in this invention may be employed without modification. However, they are preferably chemically and/or spectrally sensitized in a manner similar to that used to sensitize conventional wet-processed silver halide photographic materials or state-of-the-art heat-developable photothermographic materials.

Thus, the photosensitive silver halides may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process*, Fourth Edition, Chapter 5, pp. 149–169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.), all incorporated herein by reference. Mixtures of one or more types of chemical sensitizing agents can also be used.

One method of chemical sensitization is by oxidative decomposition of a spectral sensitizing dye in the presence of a photothermographic emulsion, as described in U.S. Pat. No. 5,891,615 (Winslow et al.), incorporated herein by reference.

Sulfur-containing chemical sensitizers useful in the present invention are well known in the art and described for example, in Sheppard et al., *J. Franklin Inst.,* 1923, 196, pp. 653 and 673, C. E. K. Mees and T. H. James, *The Theory of the Photographic Process,* 4$^{th}$ Edition, 1977, pp. 152–3, Tani, T., *Photographic Sensitivity: Theory and Mechanisms*, Oxford University Press, NY, 1995, pp. 167–176, U.S. Pat. No. 5,891,615 (Winslow et al.), Zavlin et al., IS&T's 48$^{th}$ Annual Conference Papers, May 7–11, 1995 Washington D.C., pp. 156–6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller), all incorporated herein by reference.

Particularly useful sulfur-containing chemical sensitizers are tetrasubstituted thiourea compounds, preferably such thiourea compounds that are substituted with the same or different aliphatic substituents, and more preferably, those that are substituted with the same aliphatic substituent. Such useful thioureas are described for example in U.S. Pat. No. 5,843,632 (Eshelman et al.) and in copending and commonly assigned U.S. Ser. No. 09/667,748 (filed Sep. 21, 2000 by Lynch, Simpson, Shor, Willett, and Zou), incorporated herein by reference.

Particularly, useful tellurium-containing chemical sensitizing compounds are described in copending and commonly assigned U.S. Ser. No. 09/746,400 (filed Dec. 21, 2000 by Lynch, Opatz, Shor, Simpson, Willett, and Gysling), incorporated herein by reference.

Useful combinations of sulfur- or tellurium-containing chemical sensitizers with gold(III) chemical sensitizers are described in copending and commonly assigned U.S. Ser. No. 09/768,094 (filed Jan. 24, 2001 by Simpson, Whitcomb, and Shor), incorporated herein by reference.

The total amount of chemical sensitizers that may be used during formulation of the imaging composition will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 $\mu$m. The upper limit can vary depending upon the compound used, the level of silver halide and the average grain size, and it would be readily determinable by one of ordinary skill in the art.

In general, it may also be desirable to add spectral sensitizing dyes to one or more imaging layers to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.), U.S. Pat. No. 5,541,054 (Miller et al.), U.S. Pat. No. 5,281,515 (Delprato et al.), and U.S. Pat. No. 5,314,795 (Helland et al.), all incorporated herein by reference, are effective in the practice of the invention.

An appropriate amount of spectral sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers for infrared photothermographic materials.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Source of Reducible Silver Ions

The non-photosensitive source of reducible silver ions used in photothermographic materials of the present invention can be any compound that contains reducible silver (1+) ions in catalytic association with the photosensitive silver halide. Preferably, it is a silver salt that is comparatively stable to light and forms a silver image when heated to 50° C. or higher in the presence of an exposed photosensitive silver halide and a reducing agent composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Most preferably, at least silver behenate is present as the non-photosensitive source of reducible silver ions.

Preferred examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and providing coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

Non-photosensitive sources of reducible silver ions can also be provided as core-shell silver salts such as those described in commonly assigned and copending U.S. Ser. No. 09/761,954 (filed Jan. 17, 2001 by Whitcomb and Pham), incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in copending U.S. Ser. No. 09/812,597 (filed Mar. 20, 2001 by Whitcomb), incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

The methods used for making silver soap dispersions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

Phosphors

Phosphors are materials that emit infrared, visible, or ultraviolet radiation upon excitation. An intrinsic phosphor is a material that is naturally (that is, intrinsically) phosphorescent. An "activated" phosphor is one composed of a basic material which may or may not be an intrinsic phosphor, to which one or more dopant(s) has been intentionally added. These dopants "activate" the phosphor and cause it to emit infrared, visible, or ultraviolet radiation. For example, in $Gd_2O_2S$:Tb, the Tb atoms (the dopant/activator) give rise to the optical emission of the phosphor. Some phosphors, such as BaFBr, are known as storage phosphors. In these materials, the dopants are involved in the storage as well as the emission of radiation.

Any conventional or useful phosphor can be used, singly or in mixtures, in the practice of this invention. More specific details of useful phosphors are provided as follows.

For example, useful phosphors are described in numerous references relating to fluorescent intensifying screens, including but not limited to, *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat.

No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,116 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Preferred rare earth oxychalcogenide and oxyhalide phosphors are represented by the following formula (1):

$$M'_{(w-n)}M''_nO_wX' \quad (1)$$

wherein M' is at least one of the metals yttrium (Y), lanthanum (La), gadolinium (Gd), or lutetium (Lu), M" is at least one of the rare earth metals, preferably dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), X' is a middle chalcogen (S, Se, or Te) or halogen, n is 0.002 to 0.2, and w is 1 when X' is halogen or 2 when X' is a middle chalcogen. These include rare earth-activated lanthanum oxybromides, and terbium-activated or thulium-activated gadolinium oxides such as $Gd_2O_2S$:Tb.

Other suitable phosphors are described in U.S. Pat. No. 4,835,397 (Arakawa et al.) and U.S. Pat. No. 5,381,015 (Dooms), both incorporated herein by reference, and including for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another class of phosphors are those that include a rare earth host and are rare earth activated mixed alkaline earth metal sulfates such as europium-activated barium strontium sulfate.

Particularly useful phosphors are those containing doped or undoped tantalum such as $YTaO_4$, $YTaO_4$:Nb, $Y(Sr)TaO_4$, and $Y(Sr)TaO_4$:Nb. These phosphors are described in U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), all incorporated herein by reference.

Other useful phosphors are alkaline earth metal phosphors that can be the products of firing starting materials comprising optional oxide and a combination of species characterized by the following formula (2):

$$MFX_{1-z}I_zuM^aX^a:yA:eQ:tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Th), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$,:$Nb_2O_5$, $Ta_2O_5$, or $ThO_2$, "D" is vanadium (V), chromium (Cr), manganese (Mn), iron (Fe), cobalt (Co), or nickel (Ni). The numbers in the noted formula are the following: "z" is 0 to 1, "u" is from 0 to 1, "y" is from $1\times10^{-4}$ to 0.1, "e" is from 0 to 1, and "t" is from 0 to 0.01. These definitions apply wherever they are found in this application unless specifically stated to the contrary. It is also contemplated that "M", "X", "A", and "D" represent multiple elements in the groups identified above.

Storage phosphors can also be used in the practice of this invention. Various storage phosphors are described for example, in U.S. Pat. No. 5,464,568 (noted above), incorporated herein by reference. Such phosphors include divalent alkaline earth metal fluorohalide phosphors that may contain iodide are the product of firing an intermediate, comprising oxide and a combination of species characterized by the following formula (3):

$$(Ba_{1-a-b-c}Mg_aCa_bSr_c)FX_{1-z}I_zrM^aX^a:yA \quad (3)$$

wherein X, $M^a$, $X^a$, A, z, and y have the same meanings as for formula (2) and the sum of a, b, and c is from 0 to 4, and r is from $10^{-6}$ to 0.1. Some embodiments of these phosphors are described in more detail in U.S. Pat. No. 5,464,568 (noted above).

Still other storage phosphors are described in U.S. Pat. No. 4,368,390 (Takahashi et al.), incorporated herein by reference, and include divalent europium and other rare earth activated alkaline earth metal halides and rare earth element activated rare earth oxyhalides, as described in more detail above.

Examples of useful phosphors include: SrS:Ce,SM, SrS:Eu,Sm, $ThO_2$:Er, $La_2O_2S$:Eu,Sm, ZnS:Cu,Pb, and others described in U.S. Pat. No. 5,227,253 (Takasu et al.), incorporated herein by reference.

The one or more phosphors used in the practice of this invention are present in the photothermographic materials in an amount of at least 0.1 mole per mole, and preferably from about 0.5 to about 20 mole, per mole of total silver in the photothermographic material. Generally, the amount of total silver is at least 0.002 mol/$m^2$.

Because of the size of the phosphors used in the invention, generally the layers in which they are incorporated (usually one or more emulsion layers), have a dry coating weight of at least 5 g/$m^2$, and preferably from about 5 g/$m^2$, to about 200 g/$m^2$. Most preferably, the one or more phosphors and the photosensitive silver halide are incorporated within the same imaging layer that has a dry coating weight within the noted preferred range.

Thus, one preferred embodiment of the present invention is an X-radiation sensitive photothermographic material comprising a support having on one side thereof, a photothermographic imaging layer having a dry coating weight of from about 5 to about 200 g/m$^2$, and a surface protective layer, the imaging layer comprising a binder and in reactive association:

a. a photosensitive silver halide, b. a non-photosensitive source of reducible silver ions, c. a reducing composition for the reducible silver ions, and d. a phosphor that is sensitive to X-radiation and is present in an amount of from about 0.1 to about 20 mole per mole of total silver, the phosphor being one or more of $YTaO_4$, $YTaO_4$:Nb, Y(Sr)$TaO_4$, and Y(Sr)$TaO_4$:Nb.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.), incorporated herein by reference.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high contrast co-developing agents and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthlyl)methanes, bis(hydroxyphenyl)methanes, hindered phenols, and hindered naphthols each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alanine-hydroxamic acid), a combination of azines and sulfonamidophenols (for example, phenothiazine and 2,6-dichloro-4-benzenesulfonamidophenol), α-cyanophenyl-acetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in copending U.S. Ser. No. 09/239,182 (filed Jan. 28, 1999 by Lynch and Skoog), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers are substituted acrylonitrile compounds that can be represented by structure III as follows:

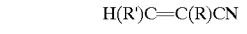

$$H(R')C{=}C(R)CN \qquad \text{III}$$

wherein R is a substituted or unsubstituted aryl group of 6 to 14 carbon atoms in the single or fused ring structure (such as phenyl, naphthyl, p-methylphenyl, p-chlorophenyl, 4-pyridinyl and o-nitrophenyl groups) or an electron withdrawing group (such as a halo atom, cyano group, carboxy group, ester group and phenylsulfonyl group). R' is a halo group (such as fluoro, chloro and bromo), hydroxy or metal salt thereof, a thiohydrocarbyl group, an oxyhydroxycarbyl group, or a substituted or unsubstituted 5- or 6-membered aromatic heterocyclic group having only carbon atoms and 1 to 4 nitrogen atoms in the central ring (with or without fused rings attached), and being attached through a non-quaternary ring nitrogen atom (such as pyridyl, furyl, diazolyl, triazolyl, pyrrolyl, tetrazolyl, benzotriazolyl, benzopyrrolyl and quinolinyl groups). Further details of these compounds and their preparation can be found in U.S. Pat. No. 5,635,339 (Murray) and U.S. Pat. No. 5,545,515 (Murray et al.), both incorporated herein by reference.

Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, or an optical density increase of at least 0.2 units or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes are what are known as "aldazine" and "ketazine" leuco dyes, which are described for example in U.S. Pat. No. 4,587,211 (Ishida et al.) and U.S. Pat. No. 4,795,697 (Vogel et al.), both incorporated herein by reference.

Still another useful class of dye-releasing compounds are those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Imaging Precursor Emulsions

As pointed out above, this invention also provides various imaging precursor emulsions that can be formulated and used to prepare the photothermographic materials of this invention. Such imaging precursor emulsions comprise one or more phosphors as described above, in suitable amounts, and two or more of the essential imaging components: that is, one or more photosensitive silver halides, one or more non-photosensitive sources of reducible silver ions, and one or more reducing compositions for the reducible silver ions, all of which are described above.

Thus, one such imaging precursor emulsion can comprise one or more phosphors in combination with one or more photosensitive silver halides and one or more non-photosensitive sources of reducible silver ions.

Another suitable imaging precursor emulsion can comprise one or more phosphors in combination with one or more photosensitive silver halides and one or more reducing compositions for the reducible silver ions.

Still another useful imaging precursor emulsion can comprise one or more phosphors in combination with one or more non-photosensitive sources of reducible silver ions and one or more reducing compositions for the reducible silver ions.

Yet another useful imaging precursor emulsion can include one or more phosphors in combination with one or more photosensitive silver halides, one or more non-photosensitive sources of reducible silver ions, and one or more reducing compositions for the reducible silver ions.

The various amounts of each essential imaging component in the various imaging precursor emulsions would be readily apparent to one skilled in the art from the teaching provided above for the individual components.

In addition, each imaging precursor emulsion can include various addenda as described in the following disclosure. Preferably, the imaging precursor emulsions comprise one or more binders (particularly hydrophobic binders) as described below.

Other Addenda

The photothermographic materials of this invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

The photothermographic materials can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767B1 (Kong et al).

Furthermore, other useful antifoggants/stabilizers are described in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600 586 (Philip, Jr. et al.), and tribromomethylketones as described, for example, in EP-A-0 600,587 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the thermographic and photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photosensitive silver halide, the non-photosensitive source of reducible silver ions, the reducing agent composition, the phosphor and any other additives used in the present invention are generally added to one or more binders that are either hydrophilic or hydrophobic. Thus, either aqueous- or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Examples of useful hydrophilic binders include, but are not limited to, gelatin and gelatin-like derivatives (hardened or unhardened), cellulosic materials such as cellulose acetate, cellulose acetate butyrate, hydroxymethyl cellulose, acrylamide/methacrylamide polymers, acrylic/methacrylic polymers polyvinyl pyrrolidones, polyvinyl acetates, polyvinyl alcohols, and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder not be decomposed or lose its structural integrity at 120° C. for 60 seconds. It is more preferred that it not be decomposed or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention can be prepared using a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure*, August 1979, item 18431. A method of making dimensionally stable polyester films is described in *Research Disclosure*, September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) is preferably prepared by dissolving and/or dispersing a hydrophobic binder, the photothermographic emulsion (generally including the photosensitive silver halide and the non-photosensitive source of reducible silver ions) the reducing composition, the phosphor, and optional addenda in an organic solvent, such as toluene, 2-butanone (methyl ethyl ketone), acetone, or tetrahydrofuran. As noted above, these components can be distributed between two or more imaging layers. In some instances, some of the components can be formulated in a topcoat formulation and allowed to migrate into lower imaging layers.

Alternatively, these components can be formulated with a hydrophilic binder in water or water-organic solvent mixtures to provide aqueous-based coating formulations.

Photothermographic materials can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying the photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photosensitive silver halide, the non-photosensitive source of reducible silver ions, the reducing composition, the binder, the phosphor, as well as optional materials such as toners, acutance dyes, coating aids and other adjuvants.

Two-layer constructions comprising a single imaging layer coating containing all the ingredients and a protective topcoat are generally found in the materials of this invention. However, two-layer constructions containing photosensitive silver halide and non-photosensitive source of reducible silver ions in one imaging layer (usually the layer adjacent to the support) and the reducing composition and other ingredients (including phosphor) in the second imaging layer or distributed between both layers are also envisioned. Preferably, in such constructions, the phosphor is in the same layer as the photosensitive silver halide.

Layers to promote adhesion of one layer to another are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S.

Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers, described above, may be used. Such formulations are described in copending and commonly assigned U.S. Ser. No. 09/510,648 (filed Feb. 23, 2000 by Ludemann, LaBelle, Geisler, Warren, Crump, and Bhave), incorporated herein by reference.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

To promote image sharpness, photothermographic materials can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

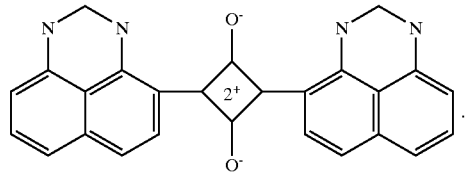

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

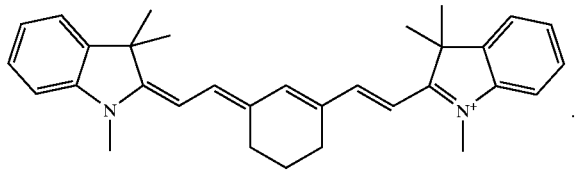

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

It is also possible to employ acutance or antihalation dyes that will decolorize with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), and EP-A-0 911 693 (Sakurada et al.).

Imaging/Development

The photothermographic materials of the present invention can be imaged using any suitable X-radiation imaging source to provide a latent image. Suitable exposure means are well known and include medical, mammographic, dental, and industrial X-ray units.

When storage phosphors are incorporated within the photothermographic materials, the initial exposure to X-radiation is "stored" within the phosphor particles. When the material is then later exposed a second time to stimulating electromagnetic radiation (usually to visible light or infrared radiation), the "stored" energy is then released as an emission of visible or infrared radiation. The photothermographic materials may then be developed by heating. BaFBr disclosed herein is such a storage phosphor.

It may also be desirable to use the photothermographic materials of this invention in combination with one or more conventional fluorescent intensifying screens (also known as radiographic phosphor panels) or metal intensifying screens.

Such screens are well known in the art [for example, U.S. Pat. No. 4,865,944 (Roberts et al.) and U.S. Pat. No. 5,021,327 (Bunch et al.)]. For example, a fluorescent intensifying screen can be positioned in "front" of the photothermographic material so exposing X-radiation passes through the screen before striking the photothermographic material. Other conventional arrangements of screens and photothermographic materials in imaging assemblies or cassettes would be readily apparent to a skilled artisan.

Heat development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Materials and Methods for the Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 or PARALOID A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co. (Kingsport, Tenn.).

CBBA is chlorobenzoylbenzoic acid.

DESMODUR® N3300 is an aliphatic hexamethylene diisocyanate available from Bayer Chemicals (Pittsburgh, Pa.).

MEK is methyl ethyl ketone (or 2-butanone).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

Phosphors were obtained from Nichia America Corp. (Mountville, Pa.).

Phosphor P-1 is $Gd_2O_2S$:Tb. It is a green emitting phosphor.

Phosphor P-2 is $Y(Sr)TaO_4$. It is an ultraviolet emitting phosphor.

Phosphor P-3 is $Y(Sr)TaO_4$:Nb.

Phosphor P-4 is $CaWO_4$.

Phosphor P-5 is BaFBr:Eu.

"PHP" is pyridinium hydrobromide perbromide.

Chemical Sensitizer A is

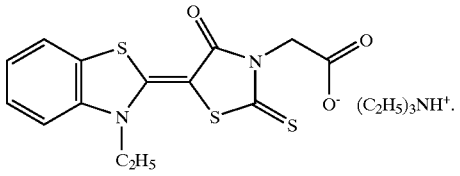

CS-A

Chemical Sensitizer B (CS-B) is Au(III)(terpyridine)$Cl_3$. It is described in L. Hollis et al., *J. Am. Chem. Soc.,* 1983, 105, 4293 and in U.S. Ser. No. 09/768,094 (noted above).

Spectral Sensitizing Dye A is

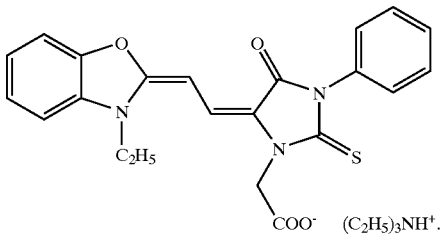

SSD-A

Spectral Sensitizing Dye B is

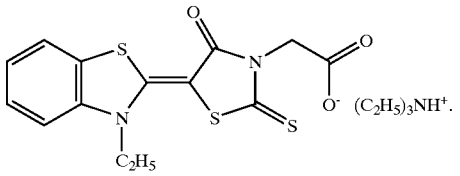

SSD-B

High contrast Compound HC-1 is described in U.S. Pat. No. 5,545,515 (noted above) and has the following structure:

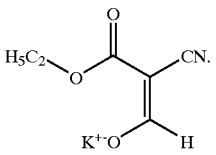

Vinyl Sulfone-1 (VS-1) is described in EP-0 600 589B1 and has the following structure:

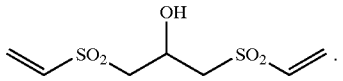

Antifoggant A is 2-(tribromomethylsulfonyl)quinoline and has the following structure:

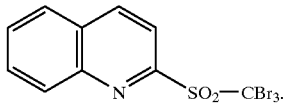

Antifoggant B is:

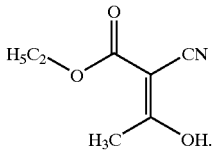

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

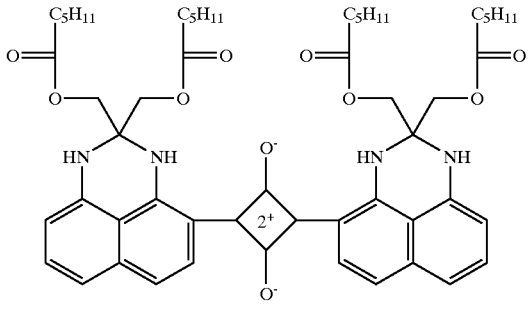

BC-1

The photothermographic emulsions were chemically sensitized according to procedures described in U.S. Pat. No. 5,891,615 (noted above), or U.S. Ser. No. 09/768,094 (noted above). In addition, some emulsions were prepared and evaluated without being spectrally sensitized. Others were spectrally sensitized to the wavelength of interest.

The following examples are provided to illustrate the practice of this invention, and are not intended to be limiting in any manner.

EXAMPLE 1

Green-sensitive photothermographic emulsion formulations were prepared as follows:

Preparation of Photothermographic Soap Dispersion

A preformed silver halide, silver carboxylate soap dispersion was prepared as described in U.S. Pat. No. 5,382,504 (noted above). The average silver halide grain size was 0.12 μm. The photothermographic emulsion was prepared from the soap dispersion noted below in a manner similar to that described in U.S. Pat. No. 6,083,681 (Lynch et al.), incorporated herein by reference.

Photothermographic emulsion s were prepared from the photosensitive silver soap dispersions prepared above as follows:

Formulation A

To 194.3 g of this silver soap dispersion at 23.5% solids were added, in order:

| | |
|---|---|
| CS-A | 0.02 g in 5.0 g of methanol |
| PHP | 0.20 g in 1.58 g of methanol |
| Calcium bromide | 0.15 g in 1.19 g of methanol |
| Dye premix | (see below for ingredients) |
| BUTVAR ® B-79 polyvinyl butyral | 20 g |
| Antifoggant A | 0.6 g in 10 g of MEK |
| PERMANAX WSO | 10.6 g |
| DESMODUR ® N3300 | 0.63 g in 1.5 g of MEK |
| Tetrachlorophthalic acid | 0.35 g in 2.0 g of MEK |
| Phthalazine | 1.00 g in 5.0 g of MEK |
| 4-methylphthalic acid | 0.45 g in 4.0 g of MEK |
| MEK | amount necessary to make 250 g total batch size |

Spectral Sensitizing Dye Solution for Green Sensitization:

| | |
|---|---|
| Spectral Sensitizing Dye-A | 0.020 g |
| Chlorobenzoyl benzoic acid | 1.42 g |
| Methanol | 5.0 g |

To 25.0 g of this photothermographic emulsion were added 4.6, 9.2, or 13.8 g of phosphors P-1 or P-2. The materials were mixed for 10 minutes to prepare final photothermographic coating formulations. The resulting ratios of phosphor to total silver in the coating formulations were from 0.9 to 3.5 mol/mol total Ag. A control formulation was prepared without phosphor particles.

Protective Topcoat Formulation:

A protective topcoat for the photothermographic formulation layer was prepared as follows:

| | |
|---|---|
| ACRYLOID ™-21 or PARALOID ™-21 | 0.58 g |
| CAB 171-15S | 14.9 g |
| MEK | 184 g |
| VS-1 | 0.3 g |
| Benzotriazole | 1.6 g |
| Antifoggant B | 0.12 g |

Both the photothermographic coating and topcoat formulations were simultaneously coated under safelight conditions using a dual knife coater onto a 7 mil (178 μm) blue-tinted polyethylene terephthalate support provided with a backside antihalation layer comprising dye BC-1 in CAB 171-15S resin binder. Samples were dried for 5 minutes at 82° C. unless otherwise specified. The approximate phosphor coating weights were from 16 to 57 g/m$^2$.

Photothermographic materials and phosphors used to prepare the coating the photothermographic emulsion formulations are shown below in TABLE I

TABLE I

| Sample | Film | Phosphor | Average Phosphor Size (μm)* | Mole Phosphor/ Mole Ag | Amount of Phosphor (g/m$^2$) |
|---|---|---|---|---|---|
| 1-1 | Control | None | | 0 | 0 |
| 1-2 | Invention | P-1 | 4 | 1.8 | 32 |
| 1-3 | Invention | P-1 | 4 | 2.7 | 54 |
| 1-4 | Invention | P-1 | 2 | 0.9 | 16 |
| 1-5 | Invention | P-1 | 2 | 1.8 | 18 |

TABLE I-continued

| Sample | Film | Phosphor | Average Phosphor Size (μm)* | Mole Phosphor/ Mole Ag | Amount of Phosphor ($g/m^2$) |
|---|---|---|---|---|---|
| 1-6 | Invention | P-1 | 2 | 2.7 | 55 |
| 1-7 | Invention | P-2 | 5 | 1.2 | 14 |
| 1-8 | Invention | P-2 | 5 | 2.3 | 31 |
| 1-8 | Invention | P-2 | 5 | 3.5 | 57 |

*average particle size

The photothermographic materials were exposed both with and without external commercially available phosphor intensifying screen as described below.

Experiment #1

The sensitometric response of the photothermographic materials was determined by exposing samples using a very stable, constant potential X-ray unit operating at 80 kVp filtered with 2.5 mm sheet of aluminum. A series of X-ray exposures were made of constant intensity and duration. Between each exposure, a translation stage moved the experimental sample away from the X-ray source in steps that created a change in exposure of 0.10 $\log_{10}E$ per step. Such a device is called an inverse square X-ray exposing system. Upon completion of the exposure sequence, the samples were developed by heating at 123° C. for 15 seconds.

Experiment #2

Imaging exposures were made using a 70 kVp, single-phase X-ray unit, filtered with 2.5 mm sheet of aluminum. The films were placed approximately 1.5 meters from the imaging source, and various "phantoms" were placed on the films. These "phantoms" are made of bone, plastic, and metal, and are very commonly used to evaluate imaging systems in radiography. The films were then exposed to a density of 1.4 above the base density of the film. The amount of radiation required to achieve this result was recorded for each film.

The imaged films were then developed by heating at 123° C. for 15 seconds. Visual assessments of the image quality were made by recording the resolution, image contrast, and noise. Imaging conditions and results are provided in TABLE II below.

The data shown below, demonstrate the increased speeds for green-sensitive photothermographic materials as coating weights of the incorporated phosphor increased as compared to the commercially available photographic KODAK ULTRASPEED X-ray Film 4502. These speeds and images were also observed for the materials in contact with external X-ray screens. This speed was observed regardless of phosphor size or type. Without the addition of external screens, resolution was also comparable to the commercially available film.

TABLE II

| Sample | Film | External X-Ray Screen | Relative speed | Resolution (Line pairs per mm) |
|---|---|---|---|---|
| | 4502** | None | 100 | >>20 |
| 1-2 | Invention | None | 1.6 | >>20 |
| 1-3 | Invention | None | 3.7 | >>20 |

TABLE II-continued

| Sample | Film | External X-Ray Screen | Relative speed | Resolution (Line pairs per mm) |
|---|---|---|---|---|
| 1-4 | Invention | None | 0.7 | >>20 |
| 1-5 | Invention | None | 0.8 | >>20 |
| 1-6 | Invention | None | 3.5 | >>20 |
| 1-7 | Invention | None | 0.6 | >>20 |
| 1-8 | Invention | None | 1.3 | >>20 |
| 1-9 | Invention | None | 2.8 | >>20 |
| 1-2 | Invention | Y | 22 | 20 |
| 1-3 | Invention | Y | 41 | 20 |
| 1-4 | Invention | Y | 18 | 12 |
| 1-5 | Invention | Y | 17 | 12 |
| 1-6 | Invention | Y | 41 | 16 |
| 1-7 | Invention | Y | 12 | 20 |
| 1-8 | Invention | Y | 20 | 20 |
| 1-9 | Invention | Y | 21 | 20 |
| 1-2 | Invention | V | 21 | 15 |
| 1-3 | Invention | V | 37 | 15 |
| 1-4 | Invention | V | 17 | 12 |
| 1-5 | Invention | V | 16 | 12 |
| 1-6 | Invention | V | 40 | 12 |
| 1-7 | Invention | V | 10 | 15 |
| 1-8 | Invention | V | 15 | 12 |
| 1-9 | Invention | V | 21 | 12 |

**Control film sold by Eastman Kodak under the name ULTRASPEED X-Ray Film.
External Screen V is Kodak Min-R 2190 screen and contains $Gd_2O_2S$ phosphor.
External Screen Y is DuPont Ultra Vision Rapid Screen and contains $YTaO_4$ phosphor in a "back screen" configuration.

EXAMPLE 2

Green-sensitive photothermographic emulsion formulations were prepared as follows:

Preparation of Photothermographic Soap Dispersion

A preformed silver halide, silver carboxylate soap dispersion was prepared as described in U.S. Pat. No. 5,382,504 (noted above). The average silver halide grain size was 0.12 μm. The photothermographic emulsion was prepared from the soap dispersion noted below in a manner similar to that described in U.S. Pat. No. 6,083,681 (Lynch et al.), incorporated herein by reference.

Photothermographic emulsions were prepared from the photosensitive silver soap dispersions prepared above as follows:

Formulation B (Green-sensitive):

To 195.6 g of this silver soap dispersion at 23.5% solids were added, in order:

| | |
|---|---|
| CS-A | 0.02 g in 5.0 g of methanol |
| PHP | 0.20 g in 1.58 g of methanol |
| Calcium bromide | 0.15 g in 1.19 g of methanol |
| CS-B Solution | 1.26 g (see below) |
| SSD Solution | (see below for ingredients) |
| BUTVAR ® B-79 | 20 g |
| Antifoggant A | 0.6 g in 10 g of MEK |
| PERMANAX WSO | 10.6 g |
| DESMODUR ® N3300 | 0.63 g in 1.5 g of MEK |
| Tetrachlorophthalic acid | 0.35 g in 2.0 g of MEK |
| Phthalazine | 1.00 g in 5.0 g of MEK |
| 4-Methylphthalic acid | 0.45 g in 4.0 g of MEK |
| MEK | amount necessary to make 250 g total batch size |

Chemical Sensitizer Solution

| | |
|---|---|
| CS-B | 0.0052 g |
| Methanol | 50.0 g |

Spectral Sensitizing Dye solution for Green Sensitization:

| | |
|---|---|
| SSD-A | 0.020 g |
| Chlorobenzoyl benzoic acid | 1.42 g |
| Methanol | 5.0 g |

Formulation C (UV Sensitive):

UV sensitive Formulation C was prepared in the identical manner to that of Formulation A described above except that the no spectral sensitizing dye solution was added.

To 25.0 g of photothermographic emulsion were added 13.8 g of phosphors P-1 or P-2. The materials were mixed for 10 minutes to prepare final photothermographic coating formulations. The resulting ratios of phosphor to total silver in the coating formulations were from 5.0 to 5.2 mol/mol total Ag. A control formulation was prepared without phosphor particles.

Protective Topcoat Formulation T-1:

A protective topcoat for the photothermographic formulation layer was prepared as follows:

| | |
|---|---|
| ACRYLOID ™-21 or PARALOID ™-21 | 0.58 g |
| CAB 171-15S | 14.9 g |
| MEK | 184 g |
| VS-1 | 0.3 g |
| Benzotriazole | 1.6 g |
| Antifoggant-B | 0.12 g |

Protective Topcoat Formulation T-2

A second protective topcoat formulation was prepared in the identical manner as topcoat T-1 but further included 0.05 g of HC-1.

The emulsion formulation samples and topcoat formulations were coated simultaneously under safelight conditions using a dual-knife coating machine onto a 7 mil (178 $\mu$m) blue-tinted polyethylene terephthalate support optionally provided with an antihalation backing coating in CAB 171-15S resin. The silver coating weights of the samples using Formulation B or C and Topcoat-1 were approximately 2.2 g/m$^2$. The silver coating weights of the samples using Formulation B and Topcoat-2 were approximately 1.8 g/m$^2$. The phosphor-containing formulations were coated at an approximate phosphor coating weight of from 54 to 57 g/m$^2$ (2.7 to 3.4 mole phosphor/mole silver) except for Sample 2-8 that was coated at 43 g/m$^2$.

The various imaged materials are listed in the following TABLE III. They were used to demonstrate the use of phosphor particles to enhance speed in a green- or UV-sensitive, photothermographic materials having topcoats that may or may not contain high contrast agents.

TABLE III

| Sample | Film | Emulsion | Topcoat | Phosphor | Mole Phosphor/Mole Ag | Average Phosphor Size ($\mu$m) |
|---|---|---|---|---|---|---|
| 2-1 | Control A | B | 1 | None | 0 | |
| 2-2 | Control B | C | 1 | None | 0 | |
| 2-3 | Invention | B | 1 | P-1 | 2.7 | 4 |
| 2-4 | Invention | C | 1 | P-2 | 3.4 | 5 |
| 2-5 | Invention | B | 1 | P-1 | 2.7 | 2 |
| 2-6 | Invention | B | 1 | P-2 | 3.4 | 5 |
| 2-7 | Control C | B | 2 | None | 0 | |
| 2-8 | Invention | B | 2 | P-1 | 2.7 | 4 |
| 2-9 | Control D | B | 1 | None | 0 | |
| 2-10 | Invention | B | 1 | P-1 | 2.7 | 4 |
| 2-11 | Invention | B | 1 | P-2" | 3.4 | 5 |

The photothermographic materials were exposed with and without an external commercially available phosphor intensifying screen (KODAK MR 2190, KODAK UV Rapid) in the following manner:

The photothermographic materials were exposed both with and without external commercially available phosphor intensifying screen as described below. Samples were imaged and developed as described in Example 1, Experiment1 and 2.

The results of imaging and developing these materials are provided in the following TABLE IV These data show an image and relative speed of green, UV-sensitive, high (TC-1) or low contrast(TC-2) photothermographic materials with incorporated phosphor as compared to the commercially available photographic KODAK ULTRASPEED X-ray Film 4502. These speeds and images were also observed for the materials in contact with external X-ray screens. This speed was observed regardless of phosphor size or type. Without the addition of external screens, resolution was also comparable to the commercially available film.

Many of the films had very adequate speeds and excellent resolution. Although not indicated in TABLE IV, the noise was low and the contrast was adequate.

TABLE IV

| Sample | Film | Screen | Relative Speed | Resolution (line pairs/mm) |
|---|---|---|---|---|
| | 4502** | None | 100 | >20 |
| 2-1 | Invention | None | Negligible | >20 |
| 2-3 | Invention | None | 5.5 | >20 |
| 2-5 | Invention | None | 4.4 | >20 |
| 2-6 | Invention | None | 3.3 | >20 |
| 2-2 | Invention | None | Negligible | >20 |
| 2-4 | Invention | None | 18.8 | >20 |
| 2-7 | Invention | None | Negligible | >20 |
| 2-8 | Invention | None | 1.9 | >20 |
| 2-9 | Invention | None | Negligible | >20 |
| 2-10 | Invention | None | 7.4 | >20 |
| 1-11 | Invention | None | 6 | >20 |
| | 4502** | None | 100 | >20 |
| 2-1 | Invention | V | 8 | 14 |
| 2-3 | Invention | V | 39 | 14 |
| 2-5 | Invention | V | 30 | 12 |
| 2-6 | Invention | V | 22 | >20 |
| 2-2 | Invention | V | 14 | 12 |
| 2-4 | Invention | V | 63 | >20 |
| 2-7 | Invention | V | 12 | NG |
| 2-8 | Invention | V | 17 | 12 |
| 2-9 | Invention | V | 16 | 16 |
| 2-10 | Invention | V | 85 | 16 |
| 2-11 | Invention | V | 42 | >20 |
| 2-1 | Invention | Y | 14 | 12 |
| 2-3 | Invention | Y | 41 | 16 |
| 2-6 | Invention | Y | 27 | >20 |
| 2-4 | Invention | Y | 104 | 18 |
| 2-7 | Invention | Y | 25 | NG |
| 2-8 | Invention | Y | 30 | 16 |
| 2-9 | Invention | Y | 26 | 14 |
| 2-10 | Invention | Y | 81 | 12 |
| 2-11 | Invention | Y | 43 | 16 |

**Control film sold by Eastman Kodak under the name ULTRASPEED X-ray Film.

EXAMPLE 3

Blue-sensitive photothermographic emulsion formulations were prepared as follows:

Preparation of Photothermographic Emulsions

Photothermographic emulsions were prepared from the photo-sensitive silver soap dispersions prepared above as follows:

Formulation D (Blue-sensitive):

To 199.3 g of this silver soap dispersion at 23.0% solids were added in order:

| | |
|---|---|
| CS-A | 0.02 g in 5.0 g of methanol |
| PHP | 0.2 g in 1.58 g of methanol |
| Calcium bromide | 0.15 g in 1.19 g of methanol |
| Chemical Sensitizer Solution | 1.58 ml (see below for ingredients) |
| Spectral Sensitizing Dye Solution | (see below for ingredients) |
| BUTVAR ® B-79 | 20 g |
| Antifoggant A | 0.6 g in 10 g of MEK |
| PERMANOX WSO | 10.6 g |
| DESMODUR ® N3300 | 0.63 g in 1.5 g MEK |

-continued

| | |
|---|---|
| Tetrachlorophthalic acid | 0.35 g in 2.0 g of MEK |
| Phthalazine | 1.00 g in 5.0 g |
| 4-Methylphthalic acid | 0.45 g in 4.0 g of MEK |
| MEK | amount to make 250 g total batch size |

| | |
|---|---|
| CS-B | 0.0052 g |
| Methanol | 50.0 g |

Spectral Sensitizing Dye Solution for Blue Sensitization

| | |
|---|---|
| SSD-B | 0.022 g |
| Chlorobenzoyl benzoic acid | 1.42 g |
| Methanol | 5.0 g |

Formulation E (UV-Sensitive):

UV sensitive Formulation E was prepared in the identical manner to that of Formulation D described above except that at the step requiring addition of spectral sensitizing dye solution, only 1.42 g of CBBA was added.

To 25.0 g of photothermographic emulsion formulation were added 13.8 g or 18.4 g of phosphor particles P-1 or P-2. The formulations were mixed for 10 minutes to prepare coating emulsion formulation. Control materials were prepared without phosphor particles.

Protective topcoat Formulation T-2:

A protective topcoat for the photothermographic formulation layer was prepared as follows:

| | |
|---|---|
| ACRYLOID-21 | 0.58 g |
| CAB 171-15S | 14.9 g |
| MEK | 184 g |
| VS-1 | 0.15 g |
| Benzotriazole | 0.8 g |
| Antifoggant-B | 0.12 g |

Photothermographic emulsion and topcoat formulations were coated as described in Example 2. The silver coating weights of the materials were approximately 2.2 g/m$^2$. The phosphor-containing formulations were coated at approximate phosphor coating weights of 5 to 70 g/m$^2$. The resulting ratios of phosphor to total silver in the formulation were from 2.7 to 4.8 mol/mol total silver.

The imaged materials are listed in the following TABLE V. They were used to demonstrate the use of single or combination of phosphor particles to enhance speed in blue- or UV-sensitive photothermographic materials.

TABLE V

| Sample | Film | Emulsion | Phosphor | Average Phosphor Size μm | Mole Phosphor/Mole Total Silver | Amount of Phosphor (g/m$^2$) |
|---|---|---|---|---|---|---|
| 3-1 | Control A | D | None | — | 0 | 0 |
| 3-2 | Control B | E | None | — | 0 | 0 |
| 3-3 | Invention | D | P-1 | 4 | 2.8 | 50 |
| 3-4 | Invention | E | P-2 | 5 | 3.5 | 50 |
| 3-5 | Invention | E | P-I | 4 | 2.7 | 51 |
| 3-6 | Invention | D | P-2 | 5 | 3.6 | 52 |
| 3-7 | Invention | D | P-2 | 5 | 4.8 | 70 |
| 3-8 | Invention | E | P-2 | 5 | 4.7 | 70 |
| 3-9 | Invention | D | P-1, P-2 | 4, 5 | 1.4, 1.8 | 52 |
| 3-10 | Invention | E | P-1, P-2 | 4, 5 | 1.4, 1.8 | 53 |

Photothermographic materials were exposed with and without an external commercially available phosphor intensifying screen as described below.

The results of imaging and developing are provided in the following TABLES VI and VII.

These data show increased speeds for these blue- or UV-sensitive photothermographic materials as coating weights increased with incorporated phosphor as compared to the commercially available photographic KODAK ULTRASPEED X-ray Film 4502. These speeds and images were also observed for the materials in contact with external X-ray screens. This speed was observed regardless of phosphor size, type or combination. Without the addition of external screens, resolution was also comparable to the commercially available film.

The photothermographic materials of the present invention gave unexpected speed and sharpness.

TABLE VI

| | | Direct | Speed Relative to Direct X-ray Speed of 4502 | | | |
|---|---|---|---|---|---|---|
| Sample | Film | X-Ray Resolution | Speed With External Screen V | Speed With External Screen W | Speed With External Screen X | Speed With External Screen Y |
| | 4502 | 100 | | | | |
| 3-1 | Control A | Negligible | Negligible | Negligible | Negligible | Negligible |
| 3-2 | Control B | Negligible | Negligible | Negligible | Negligible | Negligible |
| 3-3 | Invention | 8 | 66 | 140 | 112 | 178 |
| 3-4 | Invention | 47 | 107 | 293 | 264 | 413 |
| 4-5 | Invention | 23 | 139 | 293 | 423 | 560 |
| 3-6 | Invention | 16 | 68 | 136 | 128 | 139 |
| 3-7 | Invention | 30 | 94 | 178 | 182 | 190 |
| 3-8 | Invention | 81 | 185 | 408 | 415 | 420 |
| 3-9 | Invention | 15 | 68 | 183 | 139 | 192 |
| 3-10 | Invention | 31 | 133 | 292 | 268 | 414 |

External screen V = Kodak Min-R 2190 screen ($Gd_2O_2S$)
External screen W = DuPont Quanta Fast Detail screen ($YTaO_4$:Nb)
External screen X = DuPont Ultra Vision Rapid screen ($YTaO_4$) in a "front screen" configuration
External screen Y = DuPont Ultra Vision Rapid screen ($YTaO_4$) in a "back screen" configuration

TABLE VII

| | | | Resolution (line pairs/mm) | | | |
|---|---|---|---|---|---|---|
| Sample | Film | Direct X-Ray Speed | With External Screen V | With External Screen W | With External Screen X | With External Screen Y |
| | 4502 | >20 | 14 | 14 | 16 | 16 |
| 3-1 | Control A | >20 | >20 | >20 | >20 | >20 |
| 3-2 | Control B | >20 | >20 | >20 | >20 | >20 |
| 3-3 | Invention | >20 | 14 | 14 | 10 | 12 |
| 3-4 | Invention | >20 | 18 | 20 | 20 | 16 |
| 3-5 | Invention | >20 | 12 | 12 | 12 | 10 |
| 3-6 | Invention | >20 | >20 | 20 | >20 | 18–20 |
| 3-7 | Invention | >20 | >20 | 20 | >20 | 18 |
| 3-8 | Invention | >20 | >20 | 18 | 20 | 16 |
| 3-9 | Invention | >20 | >20 | 12 | 18 | 16 |
| 3-10 | Invention | >20 | 18 | 14 | 16 | 14 |

External screen V = Kodak Min-R 2190 screen ($Gd_2O_2S$)
External screen W = DuPont Quanta Fast Detail screen ($YTaO_4$:Nb)

TABLE VII-continued

| Sample | Film | Direct X-Ray Speed | Resolution (line pairs/mm) With External Screen V | With External Screen W | With External Screen X | With External Screen Y |
|---|---|---|---|---|---|---|

External screen X = DuPont Ultra Vision Rapid screen ($YTaO_4$) in a "front screen" configuration
External screen Y = DuPont Ultra Vision Rapid screen ($YTaO_4$) in a "back screen" configuration

EXAMPLE 4

Preparation of Photothermographic Soap Dispersion:

A preformed silver halide grown in the presence of phenyl mercapto tetrazole (0.25 g/mole of AgX), silver carboxylate soap dispersion was prepared by the procedures described in U.S. Ser. No. 09/833,533 (noted above). The average silver halide grain size was 0.12 $\mu$m.

Photothermographic UV-sensitive emulsions were prepared as described in Formulation E of Example 3. To 25.0 g of the final emulsion formulations were added 16.1 g of phosphor particles P-2, P-3, P-4, or P-5. A control was prepared without phosphor particles.

The emulsion formulation samples and topcoat formulations were coated as described in Example 3. The silver coating weights of the samples were approximately 2.2 g/m$^2$. The phosphor-containing formulations were coated at an approximate phosphor coating weights of from 58 to 59 g/m$^2$. The resulting relationships of phosphor to total silver in the formulation were from 3.3 to 5.8 mol/mol total Ag.

The various imaged materials are listed in the following TABLES VII and IX. They were used to demonstrate the use various types of phosphor particles to enhance speed in UV-sensitive photothermographic materials.

TABLE VIII

| Sample | Film | Phosphor | Average Phosphor Size $\mu$m | Mole Phosphor/ Mole Total Silver | Amount of Phosphor (g/m$^2$) |
|---|---|---|---|---|---|
| 4-1 | Control A | None | — | 0 | 0 |
| 4-2 | Invention | P-2 | 5 | 4.0 | 59 |
| 4-3 | Invention | P-3 | 4 | 3.3 | 58 |
| 4-4 | Invention | P-4 | 6 | 5.8 | 59 |
| 4-5 | Invention | P-5 | 8–10 | 4.3 | 58 |

The photothermographic materials were exposed with and without an external commercially available phosphor intensifying screen as described in TABLE VI.

The results of imaging and developing are provided in the following TABLE IX. These data show images and speed for these UV-sensitive photothermographic materials with various incorporated phosphors as compared to the commercially available photographic KODAK ULTRASPEED X-ray Film 4502. These speeds and images were also observed for the materials in contact with external X-ray screens. This speed was observed regardless of phosphor size or type. Without the addition of external screens, resolution was also comparable to the commercially available film.

TABLE IX

| Sample | Film | Direct X-ray Speed | Resolution |
|---|---|---|---|
| | 4502 | 100 | >20 lp/mm |
| 4-1 | Control A | Negligible | |
| 4-2 | Invention | 42 | >20 lp/mm |
| 4-3 | Invention | 53 | >20 lp/mm |
| 4-4 | Invention | 21 | >20 lp/mm |
| 4-5 | Invention | 52 | >20 lp/mm |

EXAMPLE 5

Photothermographic UV-sensitive emulsions were prepared as described in Example 4 except 3.2 ml of CS-B was used. To 25.0 g of the photothermographic emulsion formulations were added 16.1 g or 18.4 g of P-2 phosphor particles and mixed for 10 minutes to prepare the coating emulsion formulations. A control material was prepared without phosphor particles.

Coating emulsion and topcoat formulations were coated as described in Example 4. The silver coating weights of the samples were approximately 2.2 g/m$^2$. The phosphor-containing formulations were coated at an approximate phosphor coating weights of from 59 to 68 g/m$^2$. The resulting relationship of phosphor to total silver in the formulations were from 4.0 to 4.6 mol/mol total Ag.

The various imaged materials are listed in the following TABLE X. They were used to demonstrate the use various amounts of phosphor particles to enhance speed in an UV-sensitive photothermographic materials.

TABLE X

| Sample | Film | Phosphor | Average Phosphor Size $\mu$m | Mole Phosphor/ Mole Total Silver | Amount of Phosphor (g/m$^2$) |
|---|---|---|---|---|---|
| 5-1 | Control A | None | — | 0 | 0 |
| 5-2 | Invention | P-2 | 5 | 4.0 | 59 |
| 5-3 | Invention | P-2 | 5 | 4.6 | 68 |

The photothermographic materials were exposed with and without an external commercially available phosphor intensifying screen as described in TABLE VI.

The results of imaging and developing are shown below in TABLES XI and XII. These data show images and increased speed for these UV-sensitive photothermographic materials with increased coating weights of the incorporated phosphors as compared to the commercially available photographic KODAK ULTRASPEED X-ray Film 4502. These speeds and images were also observed for the materials in contact with external X-ray screens. Without the addition of external screens, resolution was also comparable to the commercially available film.

TABLE XI

| | Film | Relative Direct X-ray Speed | Resolution |
|---|---|---|---|
| | 4502 | 100 | >20 lp/mm |
| 5-1 | Control A | Negligible | >20 lp/mm |
| 5-2 | Invention | 127 | >20 lp/mm |
| 5-3 | Invention | 131 | >20 lp/mm |

Invention samples 4 and 5 were also exposed with a mammographic X-ray unit (GE/DMR) at 28 kVp, using a Molybdenum anode and a Molybdenum filter. An RMI 156 (ACR) phantom was used to simulate a human breast. The inventions were compared to a typical conventional film-screen system (Kodak Min-R 2000 film with a Min-R 2000 screen). Usefully high speeds were obtained, and are shown in the following TABLE XII.

TABLE XII

| Sample | Film | External Screen | Speed with External Screen |
|---|---|---|---|
| | T | U | 150 |
| 5-2 | Invention | Y | 49 |
| 5-3 | Invention | Z | 86 |
| 5-2 | Invention | Z | 63 |

External screen Z = Kodak GP storage screen in "back screen" configuration
External screen U = Kodak Min-R 2000 screen (Gd2O2S)
Film T = Kodak Min-R 2000 Mammographic film

EXAMPLE 6

Photothermographic UV-sensitive emulsions were prepared as described in Example 5. To 25.0 g of the photothermographic emulsion formulations were added 3.4 g, 6.9 g, 10.2 g or 13.8 g of 1$\mu$, 2$\mu$, or 5$\mu$ particles of phosphor P-2. The formulations were mixed for 10 minutes to prepare the final coating emulsion formulation. A control material was also prepared without phosphor particles.

Coating emulsion and topcoat formulations were coated as described in Example 5. The silver coating weights of the samples were approximately 2.1 g/m$^2$. The phosphor-containing formulations were coated at an approximate phosphor coating weights of from 15 to 57 g/m$^2$. The resulting relationships of phosphor to total silver in the formulations were from 0.8 to 3.4 mol/mol total Ag.

The various imaged materials are listed in the following TABLE XIII. They were used to demonstrate the use various sizes and amounts of phosphor particles to enhance speed in an UV-sensitive photothermographic materials.

TABLE XIII

| Sample | Film | Phosphor | Average Phosphor Size $\mu$m | Mole Phosphor/ Mole Total Silver | Amount of Phosphor (g/m$^2$) |
|---|---|---|---|---|---|
| 6-1 | Control A | None | — | 0 | 0 |
| 6-2 | Invention | P-2 | 5 | 3.4 | 57 |
| 6-3 | Invention | P-2 | 2 | 2.5 | 41 |

TABLE XIII-continued

| Sample | Film | Phosphor | Average Phosphor Size $\mu$m | Mole Phosphor/ Mole Total Silver | Amount of Phosphor (g/m$^2$) |
|---|---|---|---|---|---|
| 6-4 | Invention | P-2 | 2 | 2.5 | 37 |
| 6-5 | Invention | P-2 | 2 | 1.7 | 30 |
| 6-6 | Invention | P-2 | 1 | 1.7 | 30 |
| 6-7 | Invention | P-2 | 2 | 0.8 | 15 |
| 6-8 | Invention | P-2 | 1 | 0.8 | 15 |

The photothermographic materials were exposed with and without an external commercially available phosphor intensifying screen as described in TABLES VI and VII.

The results of imaging and developing are provided in the following TABLES XIV and XV. These data show images and increased speed for these UV-sensitive photothermographic materials with increased coating weights and larger sizes of the incorporated phosphors as compared to the commercially available photographic KODAK ULTRASPEED X-ray Film 4502. These speeds and images were also observed for the materials in contact with external X-ray screens. This speed was observed regardless of phosphor size or type. Without the addition of external screens, resolution was also comparable to the commercially available film.

TABLE XIV

| | Film | Relative Direct X-ray Speed |
|---|---|---|
| | 4502 | 100 |
| 6-1 | Control A | 1 |
| 6-2 | Invention | 26 |
| 6-3 | Invention | 20 |
| 6-4 | Invention | 12 |
| 6-5 | Invention | 9 |
| 6-6 | Invention | 6 |
| 6-7 | Invention | 2 |
| 6-8 | Invention | 3 |

Sample 6-2 was also exposed with a mammographic X-ray unit (GE/DMR) at 28 kVp, using Molybdenum anode and a Molybdenum filter. An RMI 156 (ACR) phantom was used to simulate a human breast. The invention was compared to a typical conventional film-screen system (Kodak Min-R 2000 film with a Min-R 2000 screen). A usefully high speed was obtained as shown in the following TABLE XV.

TABLE XV

| Sample | Film | External screen | Speed with External screen |
|---|---|---|---|
| | T | U | 150 |
| 6-2 | Invention | Z | 23 |

EXAMPLE 7

The following example shows the use of the inventive materials as a film for industrial X-ray applications.

Film Sample 6-2 of Example 6 was placed in an industrial X-ray machine from XIT, Inc. Model #A 9003-200. This machine used a Type "A" X-ray cabinet with an XIT Tubehead and CMA-5 control panel. The film was placed at a distance of 36" from the X-ray source. A piece of iron with various thickness assembled similarly to a photographic step wedge was used to create and image after X-ray exposure. The sample was exposed with the wedge for 240 seconds, 200 Kv and 4 mA. The films were processed at a temperature of 123° C. for 15 seconds.

An image was observed which corresponded to the iron step wedge. Numerical markings were sharp and visible.

The invention has been described in detail with particular reference to certain preferred embodiments thereof, but it will be understood that variations and modifications can be effected within the spirit and scope of the invention.

We claim:

1. An X-radiation sensitive photothermographic material comprising a support having on at least one side thereof, one or more imaging layers comprising a binder and in reactive association:

a. a photosensitive silver halide, b. a non-photosensitive source of reducible silver ions, c. a reducing composition for said reducible silver ions, and d. a phosphor that is sensitive to X-radiation and is present in an amount of at least 0.1 mole per mole of total silver.

2. The photothermographic material of claim 1 wherein said phosphor is present in said material in an amount of from about 0.5 to about 20 mole per mole of total silver and the total silver present in said material is at least 0.002 mol/m$^2$.

3. The photothermographic material of claim 1 wherein said phosphor is calcium tungstate ($CaWO_4$), a niobium and/or rare earth activated or unactivated yttrium, lutetium, or gadolinium tantalates, a rare earth-activated or unactivated middle chalcogen phosphor, or a terbium-activated or unactivated lanthanum and lutetium middle chalcogen phosphor.

4. The photothermographic material of claim 3 wherein said phosphor is a rare earth oxychalcogenide and halide phosphor represented by the following formula (1):

$$M'_{(w-n)}M''_nO_wX' \quad (1)$$

wherein M' is at least one of the metals yttrium (Y), lanthanum (La), gadolinium (Gd), or lutetium (Lm), M" is at least one of the rare earth metals dysprosium (Dy), erbium (Er), europium (Eu), holmium (Ho), neodymium (Nd), praseodymium (Pr), samarium (Sm), tantalum (Ta), terbium (Tb), thulium (Tm), or ytterbium (Yb), X' is a middle chalcogen (S, Se, or Te) or halogen, n is 0.002 to 0.2, and w is 1 when X' is halogen or 2 when X' is a middle chalcogen.

5. The photothermographic material of claim 3 wherein said phosphor is $YTaO_4$, $YTaO_4$:Nb, Y(Sr)$TaO_4$, or Y(Sr)$TaO_4$:Nb.

6. The photothermographic material of claim 3 wherein said phosphor is the product of firing starting materials comprising optional oxide and a combination of species characterized by the following formula (2):

$$MFX_{1-z}I_zuM^aX^a{:}yA{:}eQ{:}tD \quad (2)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "Q" is BeO, MgO, CaO, SrO, BaO, ZnO, $Al_2O_3$, $La_2O_3$, $In_2O_3$, $SiO_2$, $TiO_2$, $ZrO_2$, $GeO_2$, $SnO_2$, $Nb_2O_5$, $Ta_2O_5$, or $ThO_2$, "D" is vanadium (V), chromium (Cr), manganese (Mn), iron (Fe), cobalt (Co), or nickel (Ni), "z" is 0 to 1, "u" is from 0 to 1, "y" is from $1\times10^{-4}$ to 0.1, "e" is from 0 to 1, and "t" is from 0 to 0.01.

7. The photothermographic material of claim 3 wherein said phosphor is a divalent alkaline earth metal fluorohalide phosphors characterized by the following formula (3):

$$(Ba_{1-a-b-c}Mg_aCa_bSr_c)FX_{1-z}I_zrM^aX^a{:}yA \quad (3)$$

wherein "M" is magnesium (Mg), calcium (Ca), strontium (Sr), or barium (Ba), "F" is fluoride, "X" is chloride (Cl) or bromide (Br), "I" is iodide, $M^a$ is sodium (Na), potassium (K), rubidium (Rb), or cesium (Cs), $X^a$ is fluoride (F), chloride (Cl), bromide (Br), or iodide (I), "A" is europium (Eu), cerium (Ce), samarium (Sm), or terbium (Tb), "z" is 0 to 1, "y" is from $1\times10^{-4}$ to 0.1, the sum of a, b and c is from 0 to 4, and r is from $10^{-6}$ to 0.1.

8. The photothermographic material of claim 3 wherein said phosphor is SrS:Ce,Sm, SrS:Eu,Sm, $ThO_2$:Er, $La_2O_2S$:Eu,Sm, or ZnS:Cu,Pb.

9. The photothermographic material of claim 1 wherein said photosensitive silver halide and phosphor are in the same layer.

10. The photothermographic material of claim 1 comprising the same or a different imaging layer on both sides of said support.

11. The photothermographic material of claim 1 wherein said binder is a hydrophobic binder.

12. The photothermographic material of claim 1 wherein said non-photosensitive source of reducible silver ions is a silver salt of a fatty acid having from 10 to 30 carbon atoms, or a mixture of said silver salts.

13. The photothermographic material of claim 1 wherein said one or more imaging layers further comprise a spectral sensitizing dye.

14. The photothermographic material of claim 1 wherein said photosensitive silver halide has been chemically sensitized with a sulfur-containing chemical sensitizing compound, a tellurium-containing chemical sensitizing compound, or a gold(III)-containing chemical sensitizing compound, or mixtures of any of these chemical sensitizing agents.

15. The photothermographic material of claim 1 wherein said imaging layer comprising said phosphor has a dry coating weight of at least 5 g/m$^2$.

16. The photothermographic material of claim 1 wherein said phosphor is a storage phosphor.

17. An X-radiation sensitive photothermographic material comprising a support having on one side thereof, a photothermographic imaging layer having a dry coating weight of from about 5 to about 200 g/m$^2$, and a surface protective layer, said imaging layer comprising a binder and in reactive association:

a. a photosensitive silver halide, b. a non-photosensitive source of reducible silver ions, c. a reducing composition for said reducible silver ions, and d. a phosphor that is sensitive to X-radiation and is present in an amount of from about 0.1 to about 20 mole per mole of total silver, said phosphor being one or more of $YTaO_4$, $YTaO_4$:Nb, $Y(Sr)TaO_4$, and $Y(Sr)TaO_4$:Nb.

18. The photothermographic material of claim 17 wherein said non-photosensitive source of reducible silver ions comprises at least silver behenate, and said photosensitive silver halide comprises at least silver bromide or silver bromoiodide.

19. The photothermographic material of claim 17 further comprising the same or a different photothermographic imaging layer on the backside of said support.

20. The photothermographic material of claim 17 further comprising an antihalation layer on the backside of said support.

21. A method for forming a visible image comprising:

A) imagewise exposing the photothermographic material of claim 1 to X-radiation to form a latent image, and B) simultaneously or sequentially, heating said exposed photothermographic material to develop said latent image into a visible image.

22. The method of claim 21 wherein said photothermographic material comprises a storage phosphor, and after step A, said photothermographic material is exposed to electromagnetic radiation to stimulate said storage phosphor to an emission of visible or infrared radiation.

23. The method of claim 21 for providing a radiographic image of a human or animal subject.

24. The method of claim 21 further comprising, positioning an X-radiation screen between said photothermographic material and the exposing source of X-radiation.

25. An imaging precursor emulsion comprising the following component d in combination with any two or more of the following components a, b, and c:

a. a photosensitive silver halide, b. a non-photosensitive source of reducible silver ions, c. a reducing composition for the reducible silver ions, and d. a phosphor that is sensitive to X-radiation.

* * * * *